US007376991B2

(12) United States Patent
Stewart et al.

(10) Patent No.: US 7,376,991 B2
(45) Date of Patent: May 27, 2008

(54) MEDICAL EXAMINATION TABLE

(75) Inventors: Philip Marc Stewart, Greenville, OH (US); Allen Chris Herr, Goshen, IN (US); Donald L. Wade, Goshen, IN (US); Richard Lee Turner, Celina, OH (US); Jon Edward Wells, New Bremen, OH (US)

(73) Assignee: Midmark Corporation, Versailles, OH (US)

( * ) Notice: Subject to any disclaimer, the term of this patent is extended or adjusted under 35 U.S.C. 154(b) by 239 days.

(21) Appl. No.: 10/711,754

(22) Filed: Oct. 1, 2004

(65) Prior Publication Data

US 2006/0070181 A1 Apr. 6, 2006

(51) Int. Cl.
*A47C 7/02* (2006.01)

(52) U.S. Cl. ..... 5/613; 5/694; 297/452.56; 297/354.13

(58) Field of Classification Search ..... 5/613, 5/694; 297/452.56, 354.13, 440.11
See application file for complete search history.

(56) References Cited

U.S. PATENT DOCUMENTS 3,967,328 A * 7/1976 Cox ..... 5/81.1 C
4,516,805 A * 5/1985 Leeper et al. ..... 297/330
4,702,522 A * 10/1987 Vail et al. ..... 297/452.56
4,842,257 A * 6/1989 Abu-Isa et al. ..... 267/133
4,869,554 A 9/1989 Abu-Isa et al. ..... 297/452.56
4,928,334 A 5/1990 Kita ..... 5/191
5,013,089 A 5/1991 Abu-Isa et al. ..... 297/452.64
5,393,126 A * 2/1995 Boulva ..... 297/452.56
5,402,544 A 4/1995 Crawford et al. ..... 5/616
5,439,271 A * 8/1995 Ryan ..... 297/452.56
5,503,455 A * 4/1996 Yang ..... 297/377
5,544,943 A 8/1996 Durling ..... 297/452.56
5,582,463 A * 12/1996 Linder et al. ..... 297/452.2
5,632,526 A 5/1997 McLarty, III et al. ... 297/452.64
6,035,901 A 3/2000 Stumpf et al. ..... 134/419
6,163,903 A * 12/2000 Weismiller et al. ..... 5/610
6,212,713 B1 4/2001 Kuck et al. ..... 5/617
6,226,816 B1 * 5/2001 Webster et al. ..... 5/618
6,231,125 B1 * 5/2001 Maeda et al. ..... 297/452.56
6,315,319 B1 * 11/2001 Hanson et al. ..... 280/650
6,315,364 B1 * 11/2001 Fujita et al. ..... 297/452.56
6,361,117 B1 * 3/2002 Tate ..... 297/452.56
6,439,665 B1 8/2002 Cvek ..... 297/440.11
6,494,540 B1 12/2002 Tornero ..... 297/440.1
6,499,163 B1 * 12/2002 Stensby ..... 5/618
6,511,562 B1 * 1/2003 Coffield ..... 156/66
6,568,008 B2 * 5/2003 Siepmann et al. ..... 5/617
6,611,974 B2 * 9/2003 Roit et al. ..... 5/81.1 C
6,722,742 B2 * 4/2004 Potes et al. ..... 297/452.56
6,725,479 B1 * 4/2004 Stryker et al. ..... 5/624
6,802,567 B2 * 10/2004 Bell ..... 297/440.11

(Continued)

*Primary Examiner*—Tara L. Mayo
(74) *Attorney, Agent, or Firm*—Wood, Herron & Evans, LLP

(57) ABSTRACT

A medical examination table has a seat section and a back section supported on a base. The seat and back sections are selectively adjustable to place a patient resting thereon in various positions for examination or the performance of medical procedures. The seat section has a relatively low profile that accommodates storing various accessories beneath the seat section while providing a high level of patient comfort and ensuring a low overall table height. In one embodiment, the seat section comprises a seat frame having a central open area, and a layer of web material extending over the open area.

17 Claims, 5 Drawing Sheets

U.S. PATENT DOCUMENTS

| | | | | |
|---|---|---|---|---|
| 6,880,189 | B2 * | 4/2005 | Welling et al. | 5/624 |
| 6,899,398 | B2 * | 5/2005 | Coffield | 297/452.56 |
| 6,942,300 | B2 * | 9/2005 | Numa et al. | 297/452.56 |
| 2002/0189014 | A1 * | 12/2002 | Siepmann et al. | 5/617 |
| 2003/0160494 | A1 * | 8/2003 | Coffield | 297/440.11 |
| 2004/0036336 | A1 * | 2/2004 | Veneruso | 297/354.13 |
| 2004/0068797 | A1 * | 4/2004 | Smith et al. | 5/617 |
| 2004/0124689 | A1 * | 7/2004 | Numa et al. | 297/452.56 |
| 2004/0148705 | A1 * | 8/2004 | Stryker et al. | 5/624 |
| 2005/0242652 | A1 * | 11/2005 | Kepler et al. | 297/452.56 |

* cited by examiner

MEDICAL EXAMINATION TABLE

FIELD OF THE INVENTION

The present invention relates generally to medical examination tables, and more particularly to an articulated examination table for positioning a patient between an upright, seated position and a supine position.

BACKGROUND OF THE INVENTION

Articulating medical examination tables are known in the art for supporting patients thereon and for placing patients in various positions that facilitate examination and/or the performance of various medical procedures. Conventional examination tables typically include a seat section and a back section supported on a base unit, which are moveable relative to one another and the base to place a patient in a desired position. The seat section or back section may be articulated by actuating mechanisms such as a motors, pneumatic or hydraulic cylinders, or other devices to move the seat and back sections between the various positions and to adjust the height of the seat and back sections relative to the base. Most tables, for example, have a back section that is maneuverable from a first inclined orientation, relative to the seat section, for supporting a patient in an initial, seated position, and a generally horizontal orientation, relative to the seat section, for supporting a patient in a supine position.

To help patients relax and to place them at ease during the examination or medical procedure, the examination table should be as comfortable as possible. Accordingly, examination tables have conventionally been provided with well-padded, upholstered patient support surfaces to improve patient comfort. When the thickness of the padding is too great, however, the increased overall height of the table may make it difficult for elderly or disabled persons to get onto and off of the examination table. Ensuring patient comfort with thick upholstery and providing a relatively low height represent competing objectives that are exasperated by the fact that the articulating mechanisms for the table, as well as various accessories used during examination, are conventionally located beneath the seat and back sections of the table. A need therefore exists for an examination table that provides a relatively low height while ensuring a high level of patient comfort.

SUMMARY OF THE INVENTION

The present invention provides an articulating medical examination table that has a relatively low profile patient support while maintaining a high level of patient comfort. In one embodiment, the patient support comprises a seat section and a back section mounted atop a stationary base. The back section cooperates with the seat section to support a patient, and is moveable between a first, inclined orientation for supporting the patient in a seated position, and a second, substantially horizontal orientation for supporting the patient in a supine position. The table further includes an actuating mechanism coupled to the back section for moving the back section between the first and second orientations. The seat section distributes the pressure of a patient's body supported on the table to ensure a high level of comfort.

The seat section includes a seat frame having an central open area. A layer of web material is secured to the frame and extends across the open area. In one embodiment, the seat section further comprises a cushion material, including a layer of foam and an upholstery cover layer. The cushion material is disposed over the web material and cooperates with the web material to provide a resilient, comfortable seating surface for supporting a patient thereon. The seat section has a relatively low profile, compared to conventional examination tables, and helps to accommodate the actuating mechanism or other components of the examination table beneath the seat section, while providing a relatively low overall table height. The low table height makes it much easier for patients, particularly elderly and disabled patients, to get onto and off of the table.

In another embodiment, the web material of the seat section is formed from elastomer and is stretched approximately 10% to 20% of its unstretched length as it is being secured to the seat frame. The medical examination table may further include controls mounted on the base, or provided in a foot-operated unit, for activating the actuating mechanism. In yet another embodiment, the table further includes a footboard, procedure tray, or other accessories stored beneath the seat section and which can be slid outwardly therefrom for use during examination.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
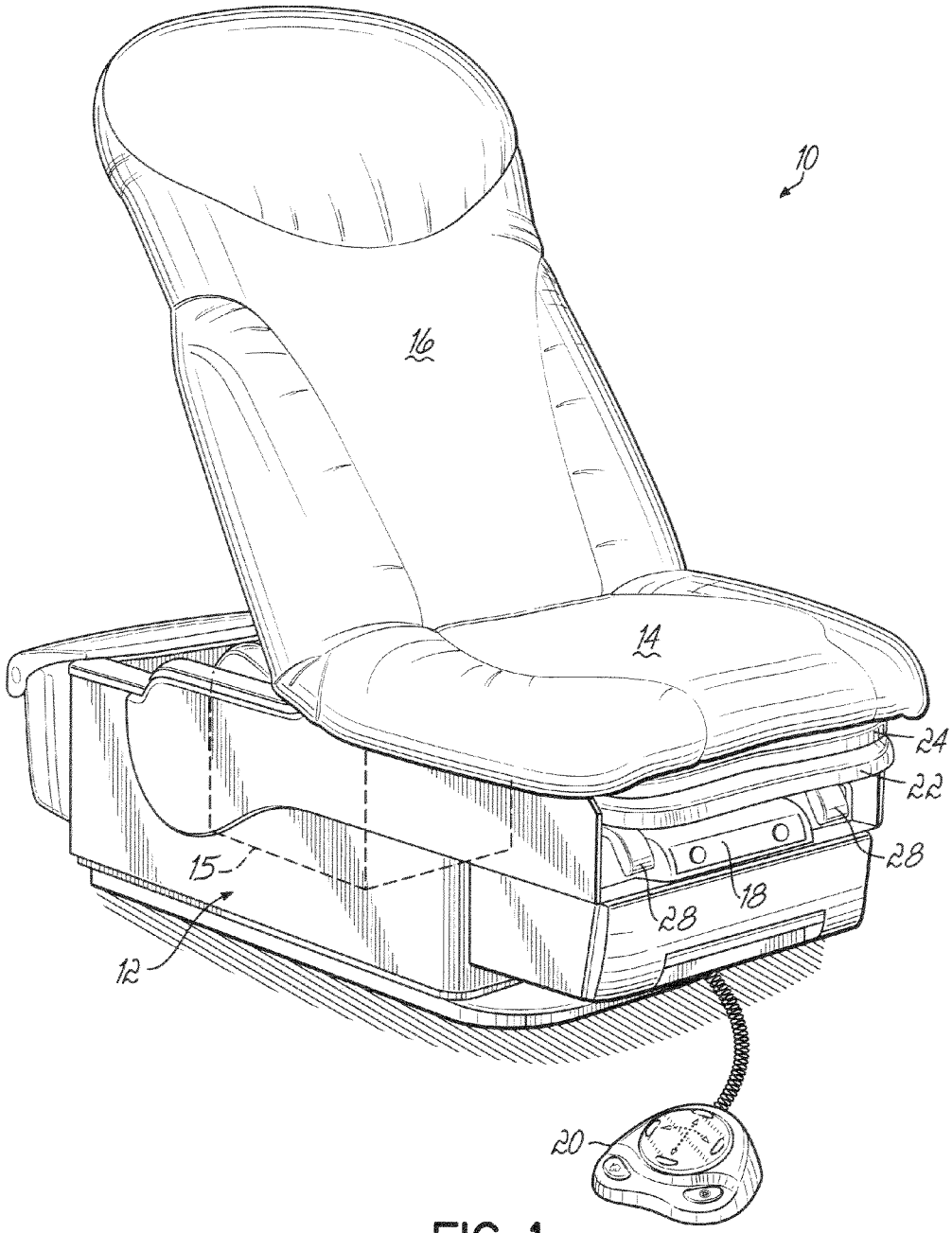
FIG. 1 is a perspective view of an exemplary medical examination table, according to the present invention, arranged to support a patient in a seated position.
Figure 2:
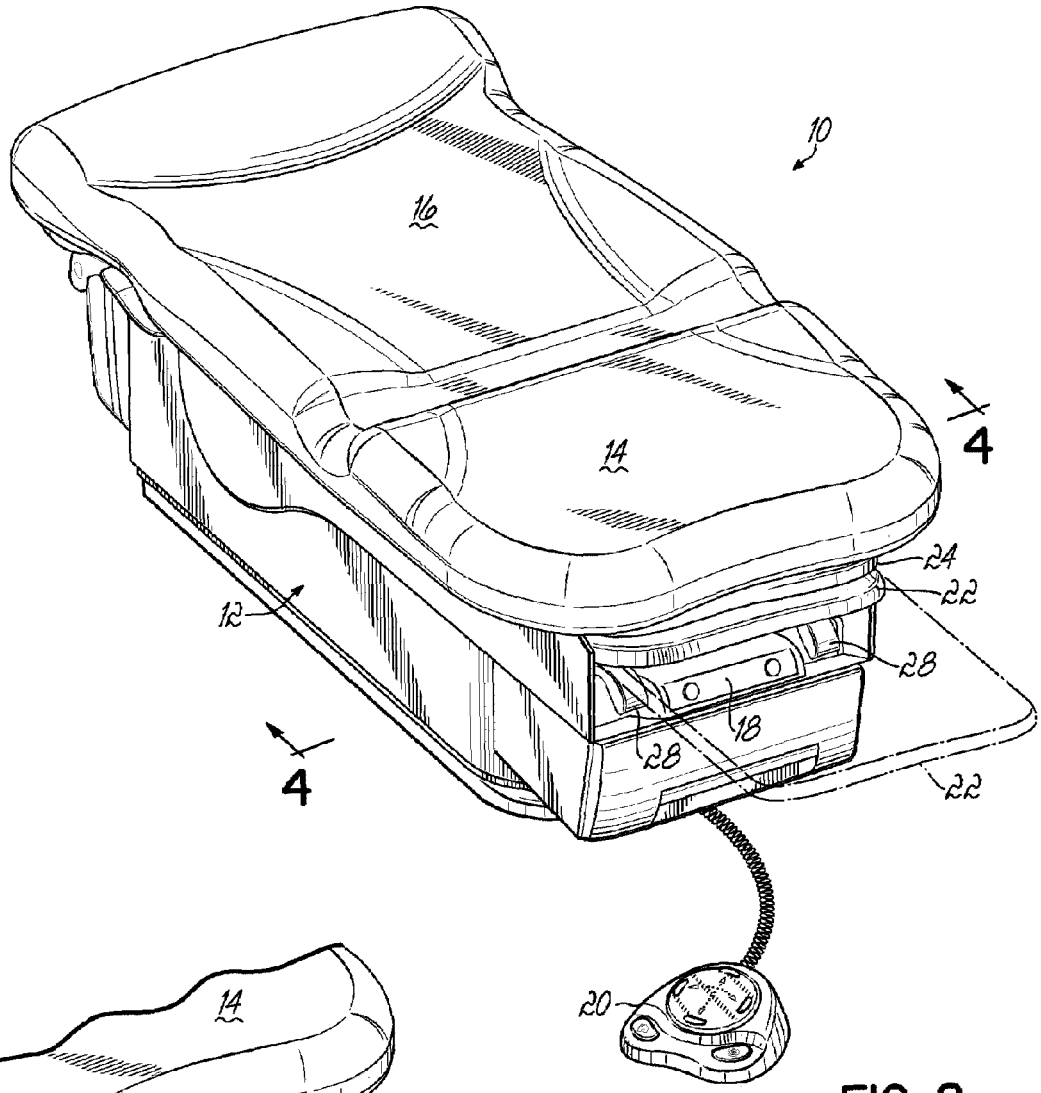
FIG. 2 is a perspective view of the examination table of FIG. 1, arranged to support a patient in a supine position.

FIG. 1 depicts an exemplary medical examination table 10 according to the present invention. The table 10 includes a stationary base 12 which houses the various mechanisms and components of the table 10. A seat section 14 and a back section 16 are mounted atop the base 12 for supporting a patient thereon. The back section 16 is moveable relative to the seat section 14 and the base 12 between a first, inclined orientation, depicted in FIG. 1, for supporting a patient in a seated position, and a second orientation wherein the back section 16 is substantially parallel to the seat section 14, as depicted in FIG. 2, for supporting a patient in a generally supine position. Typically, patients position themselves on the examination table 10 while the back section 16 is in the first, inclined position, whereafter the back section 16 and/or seat section 14 may be articulated to various other orientations to facilitate examination and/or performance of a medical procedure.

The seat and/or back sections 14, 16 are conventionally articulated between the various possible positions by an actuating mechanism 15 provided within the base 12 of the table 10. The actuating mechanism 15 may include a motor, pneumatic or hydraulic cylinders, or other mechanisms suitable for articulating the back and/or seat sections. In the embodiment shown, the table 10 further includes operator-accessible controls 18 mounted on the base 12, as well as a foot-operated control 20 coupled to the base 12 and configured to permit hands-free actuation of the articulating mechanism 15 by an operator.

Figure 2A:
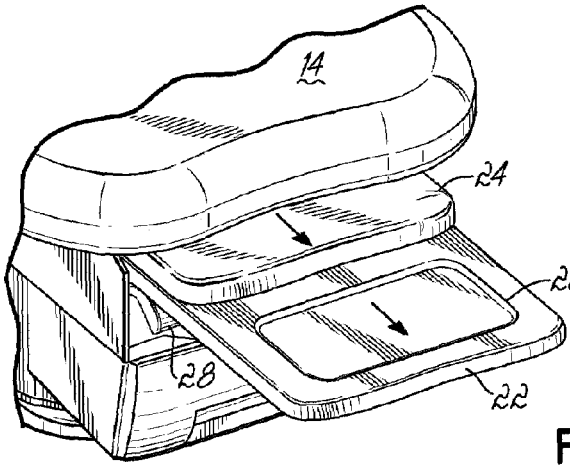
FIG. 2A is a partial perspective view of the table of FIG. 2.

In the embodiment shown, and as best depicted in FIGS. 2 and 2A, the examination table 10 further includes a procedure tray 22 and footboard 24 disposed beneath the seat section 14. The procedure tray 22 and the footboard 24 are slidably coupled to the base 12 and can be extended outwardly from a stowed position beneath the seat section 14 for use during examination. For example, the footboard 24 may be extended to support the feet of a patient resting in a supine position on the table 10. The footboard 24 may be slid back beneath the seat section 14, and the procedure tray 22 retained in the extended position to facilitate performance of a medical procedure, as may be required. In the embodiment shown, procedure tray 22 is equipped with a pan 26 for collecting fluids or medical waste, or for storing medical instruments. It will be recognized that procedure tray 22 may be provided in various other configurations to facilitate examination or the performance of medical procedures, as may be desired. Table 10 further includes a pair of brackets 28 for mounting stirrups that can be used to facilitate examination and/or the performance of medical procedures, as known in the art. While the medical table 10, shown and described herein, depicts a procedure tray 22 and footboard 24 disposed beneath the seat section 14, it will be further recognized that various other examination accessories may be stowed beneath the seat section 14 and selectively extended when needed.

Figure 3:
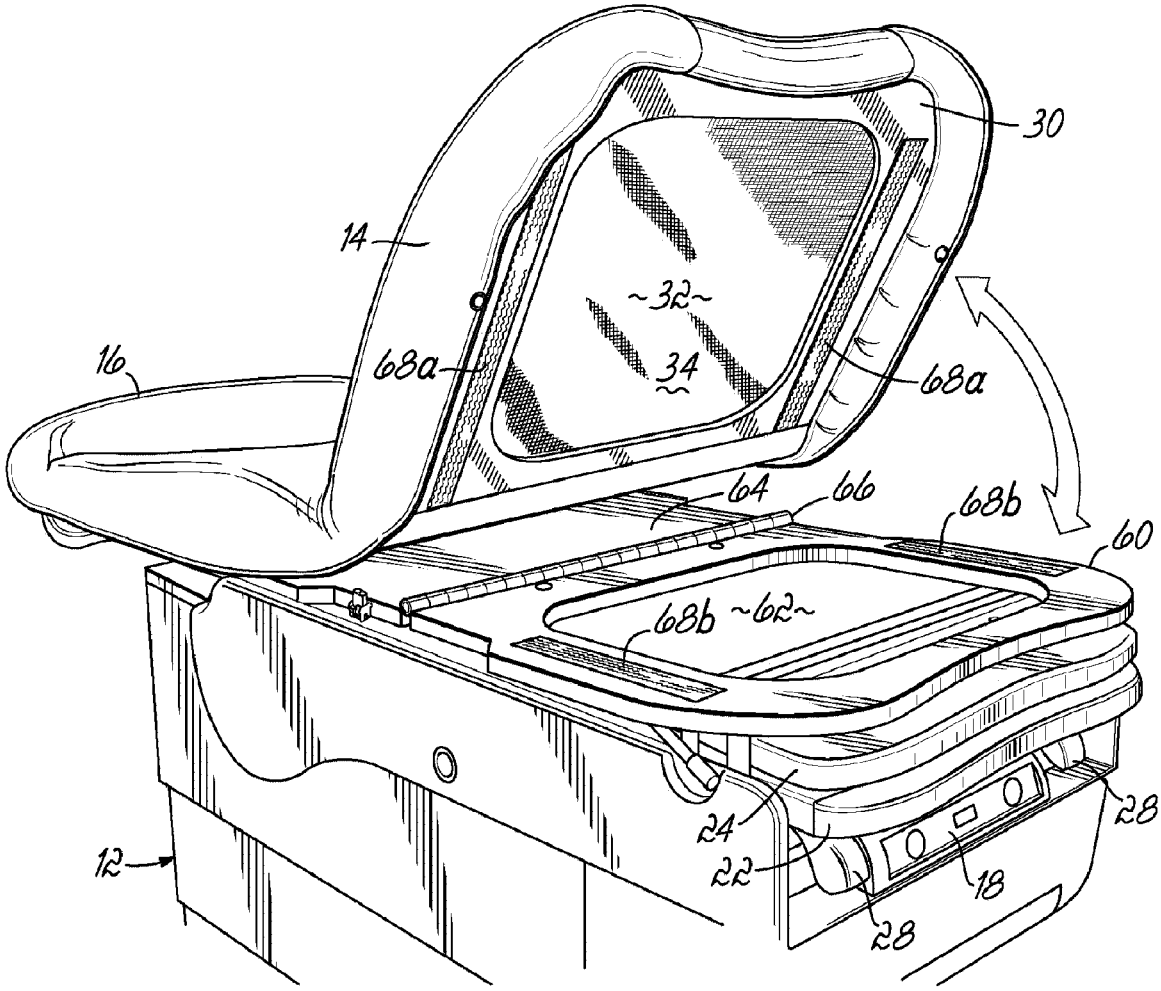
FIG. 3 is a perspective view of the examination table of FIG. 1, with the seat section raised to show detail of the seat construction.
Figure 4A:
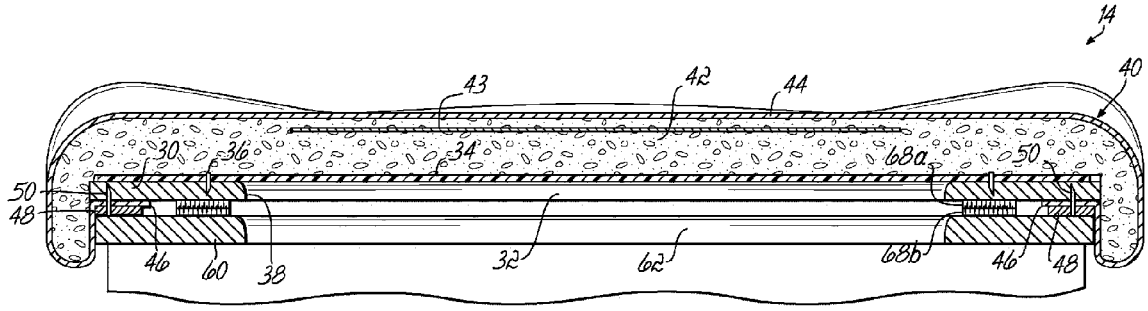
FIGS. 4A and 4B are cross-sectional views of the chair of FIG. 2, taken along line 4-4.
Figure 4B:
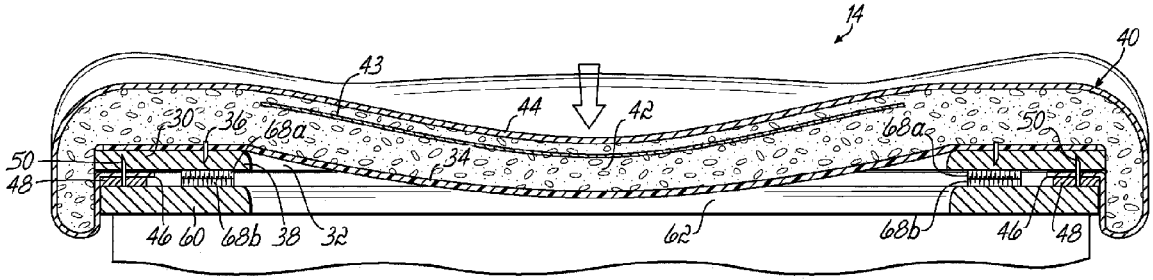

Referring now to FIGS. 3 and 4A-4B, the construction of the seat section 14 will be described in more detail. The seat section 14 includes a seat frame 30 having a generally rectangular configuration and defining a peripheral border with a central open area 32. A layer of elastomeric web material 34 is secured to the frame 30 and extends across the open area 32. In the exemplary embodiment shown, the web material 34 is secured to the frame 30 by fasteners, such as staples 36. It will be recognized, however, that the web material 34 may alternatively be secured to the frame 30 by nails, screws, clamps, adhesive, or any other attachment method suitable for securing the web material 34 to the frame 30.

In one embodiment, the web material 34 is formed from stands of polyester material and is available from Matrix Furniture Components, Inc., Greensboro, N.C. The web material 34 is stretched while it is being secured to the frame 30. The amount of stretch is selected to provide a deflection of the seating surface sufficient to ensure patient comfort, while not being so great that proper operation of the examination table 10, such as withdrawal of the footboard 24 and procedure tray 22 from beneath the seat section 14, is hindered by having the seat bottom-out against components stored beneath the seat section 14. The size of the open area 32 in the seat frame 30 is selected to permit proper deflection of the seating surface. In one embodiment, the open area 32 is wide enough so that contact through the seating surface between the inner peripheral edge 38 of the seat frame 30 and a patient's buttocks is avoided. In another embodiment, the open area 32 has a width of at least 12 inches. The inner peripheral edge 38 of the seat frame 30 is rounded to accommodate deflection of the web material 34 under the weight of a patient resting on the seat section 14.

In the embodiment shown in FIGS. 4A-4B, the seat section 14 further includes cushion material 40 disposed over the web material 34 and secured to the seat frame 14. The cushion material 40 includes a layer of foam material 42 positioned adjacent the web material 34, and an upholstery cover layer 44 disposed over the foam material 42. The seat section 14 may also be provided with a heater, depicted herein in the form of a matrix of resistive wires 43 embedded in the foam material 42, for selectively heating the seat section 14, as may be desired. The foam material 42 may extend downwardly along the side edges of the seat section 14 to provide a soft feel to the sides of the seat section 14. The upholstery cover layer 44 is wrapped around the downwardly extending edges of the foam material 42 and has its outer peripheral edges 46 secured to the seat frame 30, for example, by furring strips 48 fastened to the seat frame 30 by staples 50. It will be recognized that the cushion material 40 may alternatively be secured to the seat frame 30, for example, as by adhesives, screws, snaps or other methods suitable for securing the cushion material 40 to the seat frame 30.

In the exemplary embodiment shown, the frame 30 of the seat section 14 is attached to a generally flat seat substrate 60 coupled to the base 12. The seat substrate 60 has a central open area 62 which corresponds to the open area 32 in the seat frame 30 to accommodate deflection of the seating surface therethrough. The seat substrate 60 is also coupled to a back substrate 64 by a hinge 66 whereby the back substrate 64 and seat substrate 60 may be pivoted relative to one another about the hinge 66 to accommodate articulation of the seat and back sections 14, 16 of the table 10. In the exemplary embodiment shown, the seat frame 30 is secured to the seat substrate 60 by a hook-and-loop type fastening system 68*a*, 68*b*, such as that sold under the trademark Velcro®. Alternatively, the seat frame 30 may be secured to the seat substrate 60 by fasteners, latching mechanisms, or various other methods suitable for securing the seat frame 30 to the seat substrate 60.

Figure 5:
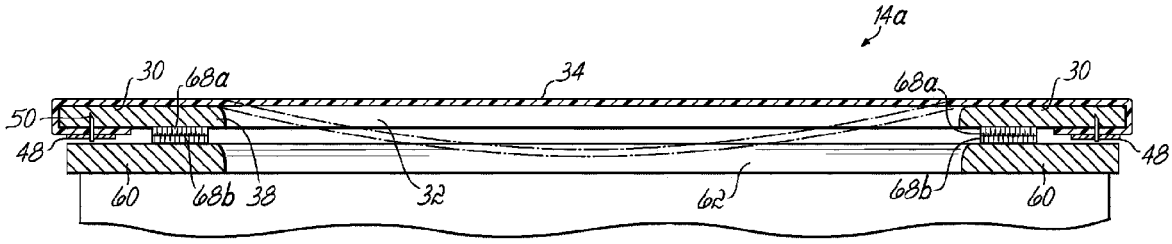
FIG. 5 is a cross-sectional view similar to FIGS. 4A-4B, depicting another embodiment of the invention.

The web material 34 allows reduced foam material thicknesses to be used in the seat section 14 so that the overall height of the examination table 10 can be kept relatively low while providing a high level of patient comfort and enabling accessories such as a procedure tray 22 and footboard 24 to be stowed beneath the seat section 14. The low height of the table 10 facilitates patients' ingress and egress from the table 10. In one embodiment, the foam material 42 used on the seat section 14 may be up to about 1.0 inch thick. In another embodiment, the foam material may be up to about 0.5 inch thick. In yet another embodiment, the foam material may be less than about 0.5 inch thick. The seat section 14 may alternatively be provided without any foam material 42 or upholstery cover layer 44. FIG. 5 depicts an embodiment wherein the seat section 14*a* comprises a layer of web material 34 stretched over and secured to the seat frame 30 without any cushion material 40. The web material may be secured to the seat frame 30 by furring strips 48 and staples 50, in a manner similar to that described above with respect to upholstery cover layer 44, or by any other method suitable for securing the web material 34 to the seat frame 30.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. An articulating medical table, comprising:

a stationary base;

a seat section mounted atop said base;

a back section atop said base and cooperating with said seat section to support a patient thereon, said back section moveable between a first, inclined orientation relative to said seat section, for supporting a patient in a seated position, and a second orientation substantially parallel to said seat section, to support a patient in a generally supine position; and an actuating mechanism coupled to said back section and selectively operable to move said back section between said first and second orientations;

said seat section comprising:

a seat substrate including a first central aperture therethough, a seat frame including a planar surface with a second central aperture therethrough, said seat frame removably coupled to said seat substrate such that said second central aperture is in registration with said first central aperture, and a layer of web material extending directly across said second central aperture and secured to said planar surface of said seat frame.

2. The medical table of claim 1, wherein said web material is formed from elastomer.

3. The medical table of claim 1, wherein said web material is stretched approximately 10% to approximately 20% of its unstretched length when it is secured to said seat frame.

4. The medical table of claim 1, further comprising foot operated controls for activating said actuating mechanism.

5. The medical table of claim 1, further comprising a footboard slidably coupled to said base, said footboard moveable from a first position disposed substantially beneath said seat section and a second position wherein said footboard extends outwardly from said seat section.

6. The medical table of claim 1, further comprising a procedure tray slidably coupled to said base, said procedure tray moveable from a first position disposed substantially beneath said seat section and a second position wherein said procedure tray extends outwardly from said seat section.

7. The medical table of claim 1, further comprising:

cushion material disposed over said web material.

8. The medical table of claim 7, wherein said cushion material includes a layer of foam material and an upholstery cover layer.

9. The medical table of claim 8, wherein said foam layer has a thickness of up to approximately 1.0 inch.

10. The medical table of claim 8, wherein said foam layer has a thickness of up to approximately 0.5 inch.

11. The medical table of claim 8, wherein said foam layer has a thickness of less than approximately 0.5 inch.

12. The medical table of claim 1, further comprising a heater associated with at least one of said seat section and said back section.

13. The medical table of claim 1, wherein said central aperture through said seat frame has a width, transverse to a longitudinal direction of the table, of at least approximately 12.0 inches.

14. The medical table of claim 1, wherein said seat substrate is hingedly coupled to said back section.

15. An articulating medical table, comprising:

a stationary base;

a seat section mounted atop said base;

a back section atop said base and cooperating with said seat section to support a patient thereon, said back section moveable between a first, inclined orientation relative to said seat section, for supporting a patient in a seated position, and a second orientation substantially parallel to said seat section, to support a patient in a generally supine position; and an actuating mechanism coupled to said back section and selectively operable to move said back section between said first and second orientations;

said seat section comprising:

a seat substrate defining a peripheral border and a first central aperture therethough, a seat frame defining a peripheral border and a second central aperture therethrough, said seat frame removably coupled to said seat substrate such that said second central aperture is in registration with said first central aperture, and a layer of web material extending across said second central aperture and secured to said seat frame, said central aperture sized to permit deflection of said web material therethrough upon loading of said seat section.

16. The medical table of claim 15, wherein said web material extends directly across said central aperture.

17. The medical table of claim 15, wherein said seat substrate is hingedly coupled to said back section.

* * * * *